US007000732B1

(12) United States Patent
Briggs Jr.

(10) Patent No.: US 7,000,732 B1
(45) Date of Patent: Feb. 21, 2006

(54) MAGNETIC TOP FOR LADDERS AND METHOD OF CONSTRUCTION THEREOF

(76) Inventor: Donald J. Briggs Jr., P. O. Box 873081, Wasilla, AK (US) 99687

( * ) Notice: Subject to any disclaimer, the term of this patent is extended or adjusted under 35 U.S.C. 154(b) by 0 days.

(21) Appl. No.: 10/791,517

(22) Filed: Mar. 2, 2004

(51) Int. Cl.
*E04G 1/00* (2006.01)
*A47G 1/17* (2006.01)
*A45F 5/00* (2006.01)

(52) U.S. Cl. ..... 182/129; 206/373; 206/350; 248/309.4; 224/183; 29/607

(58) Field of Classification Search ..... 182/129, 182/46; 248/309.4, 238, 210; 224/183; 206/350, 372, 373; 211/DIG. 1; 335/302, 335/303, 285; 29/608, 607, 602.1
See application file for complete search history.

(56) References Cited

U.S. PATENT DOCUMENTS 4,544,067 A * 10/1985 Miller ..... 211/70.6
5,098,052 A * 3/1992 Beck ..... 248/238
5,405,004 A * 4/1995 Vest et al. ..... 206/350
5,816,363 A * 10/1998 Searcy ..... 182/129
6,587,022 B1 * 7/2003 Devine ..... 335/285
6,811,127 B1 * 11/2004 Shiao ..... 248/206.5
6,836,958 B1 * 1/2005 Lee et al. ..... 29/608

* cited by examiner

*Primary Examiner*—Hugh B. Thompson, II
(74) *Attorney, Agent, or Firm*—Michael J. Tavella

(57) ABSTRACT

A ladder that has a top portion that has numerous magnets attached or embedded into it. The magnets surround the sides of the ladder top as well as attached to the underside of the top plate. In this way, tools, fasteners, paint cans, or any other metal items can be secured quickly and safely to the ladder top at any time. Moreover, because the device uses thin, flexible magnets, the ladder top is no bulkier than a normal ladder top. Finally, because of the construction, the ladder top is not covered by anything that impairs using the top in a normal way, such as sitting or standing on the top (although this is not a recommended practice, many workers routinely do this as part of their working habits). With this device, workers can fully utilize the ladder as if there was no magnetic holder attached.

11 Claims, 3 Drawing Sheets

MAGNETIC TOP FOR LADDERS AND METHOD OF CONSTRUCTION THEREOF

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates magnetic supports for ladders and particularly to a magnetic top built into a ladder.

2. Description of the Prior Art

Ladders have been used for thousands of years. The folding stepladder is one of a long progression of developments for ladders over the past few hundred years. One of the developments involving folding stepladders is the use of a support shelf. The shelf is designed to fold for storage and can hold things such as small tools and paint cans. As useful as this shelf is, there are problems. There is nothing to hold items on the shelf. Thus tools and paint cans have been known to fall from these shelves, causing injury and damage.

Several devices have been developed to retain things being used on the shelf, and indeed for items kept on other parts of the ladder. Some of these devices are found in the following patents. In U.S. Pat. No. 5,098,052, a magnetic support tray is disclosed. This tray is fastened to the support shelf on a ladder using bolts and wing nuts to make it removable. In U.S. Pat. No. 4,826,059, a magnetic tool holder is shown that can be attached to a ladder. U.S. Pat. No. 5,503,245 teaches a ladder that has a top with a webbed design that allows tools and other items to be held in the web. U.S. Pat. No. 5,758,807 discloses a magnetic paddle that holds screws and the like. The paddle can be secured to a ladder if desired. U.S. Pat. No. 6,443,260 teaches a tray that is attached to the top of a ladder using bolts or other fasteners. The tray extend forward of the ladder and has compartments that hold tools, fasteners and paint cans. Finally, U.S. Pat. No. 6,587,022 discloses a magnetic wrap that can be secured to the top of a ladder using hook and loop fasteners.

While all of these devices help workers keep organized and hold items on a ladder, they are all designed to be portable. Moreover, some of them are cumbersome and bulky.

BRIEF DESCRIPTION OF THE INVENTION

The instant invention overcomes these problems. It is a ladder that has a top portion that has numerous magnets attached or embedded into it. The magnets surround the sides of the ladder top as well as attached to the top plate. In this way, tools, fasteners, paint cans, or any other metal items can be secured quickly and safely to the ladder top at any time. Moreover, because the device uses thin, magnetic strips, the ladder top is no bulkier than a normal ladder top. Finally, because of the construction, the ladder top is not covered by anything that impairs using the top in a normal way, such as sitting or standing on the top (although this is not a recommended practice, many workers routinely do this as part of their working habits). With this device, workers can fully utilize the ladder as if there was no magnetic holder attached.

DETAILED DESCRIPTION OF THE INVENTION

Figure 1:
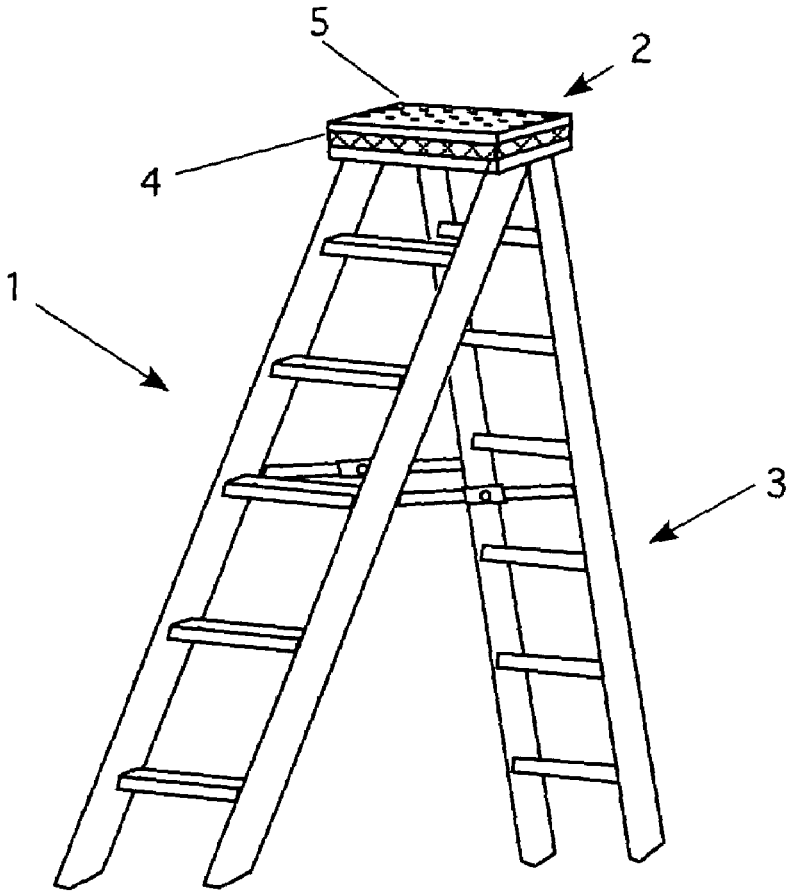
FIG. 1 is a perspective view of a ladder showing the invention in place.

Referring now to FIG. 1, a perspective view of the invention 1 is shown. The invention is a ladder top 2 that is attached to a stepladder 3. The lower portion of the ladder 3 is a standard ladder base. It has steps and a folding mechanism like any stepladder. The difference is in the top. The top 2 of the instant invention is a body that has four sides 4 that extend downward from a top plate 5. Typically, the top is rectangular as shown; however, it can be made in other configurations. For the rectangular body shown, there are two long sides 4*a* and two short sides 4*b*.

Figure 2:
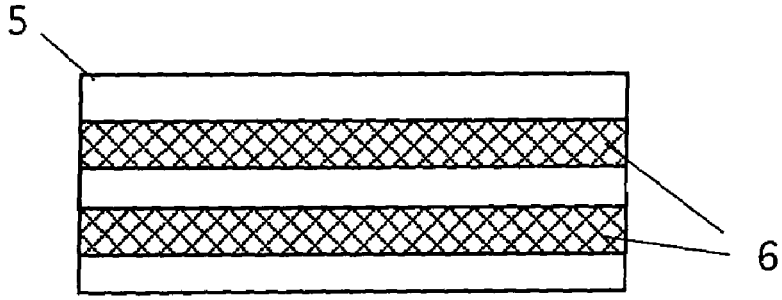
FIG. 2 is a bottom view of the ladder top showing the invention in place.

Referring now to FIG. 2, the underside of the top plate 5 is shown. Here, two magnetic strips 6 are shown. There are many ways to form the magnetic strips. In one case, or for existing ladders, magnetic strips can be attached to the ladder top using adhesives, although this is not preferred except for pre-existing ladders.

Throughout this specification, the term "strip" includes rectangular, square, round, or any other shape. Moreover, the magnets can be made of flexible material, a ceramic material or any other material that can be attached or embedded into a ladder head as described above.

Figure 3:
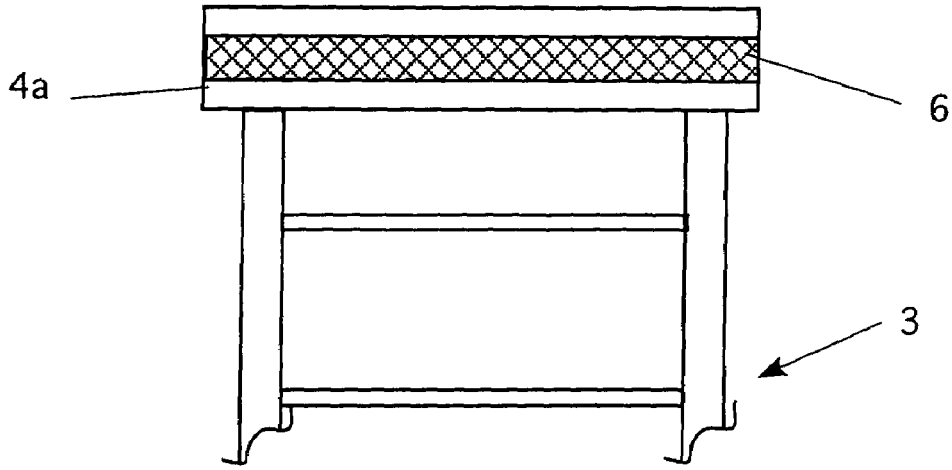
FIG. 3 is a front view of the top portion of a ladder showing the invention.
Figure 4:
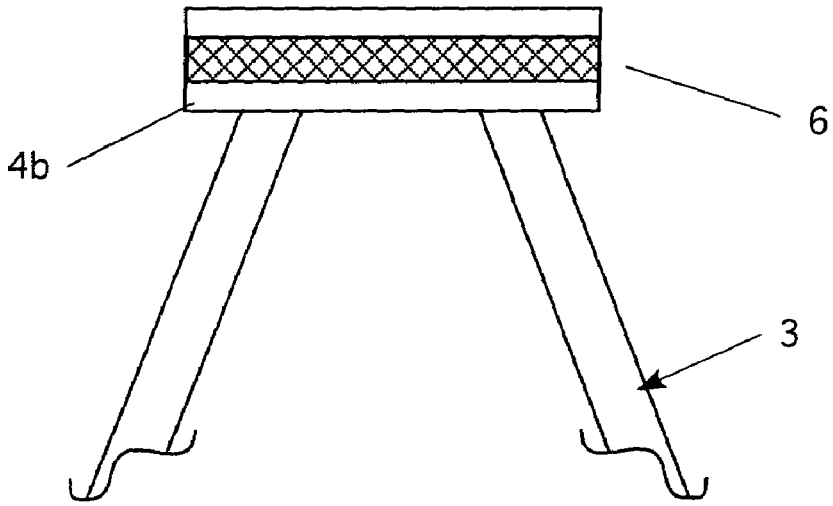
FIG. 4 is a side view of the top portion of a ladder showing the invention.

FIG. 3 shows the front of the ladder top (one of the long sides 4*a*. FIG. 4 shows one of the sides 4*b*. In both figures, magnetic strips 6 are shown attached to the sides 4*a* and 4*b*. Note that both the front and back as well as both sides of the ladder top have magnetic strips attached. This gives full coverage on the ladder and gives the user the greatest flexibility in positioning tools and equipment on the ladder top 5.

Figure 5:
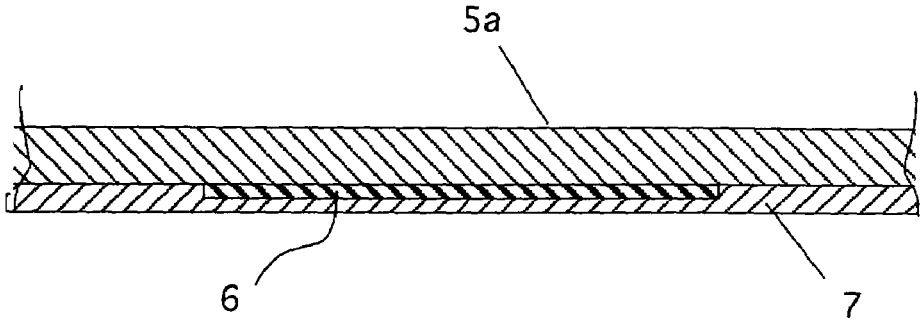
FIG. 5 is a cross-section of the ladder top showing details of one construction method.

FIG. 5 is a cross-section of the preferred ladder top. In this embodiment, the magnetic strips are embedded in the actual material of the ladder top as part of the construction of the ladder top itself. In one form, the ladder top 5*a* is formed of plastic or other materials. Magnetic strips 6 are then placed on the inner surfaces of the top and an epoxy coating 7 is then applied to the inner surface. This seals the magnetic strips in a solid coating that protects the magnetic strips and leaves them isolated from contact. This also works to insulate the ladder top, which is a safety factor when the ladder is used around electrical equipment.

Figure 6:
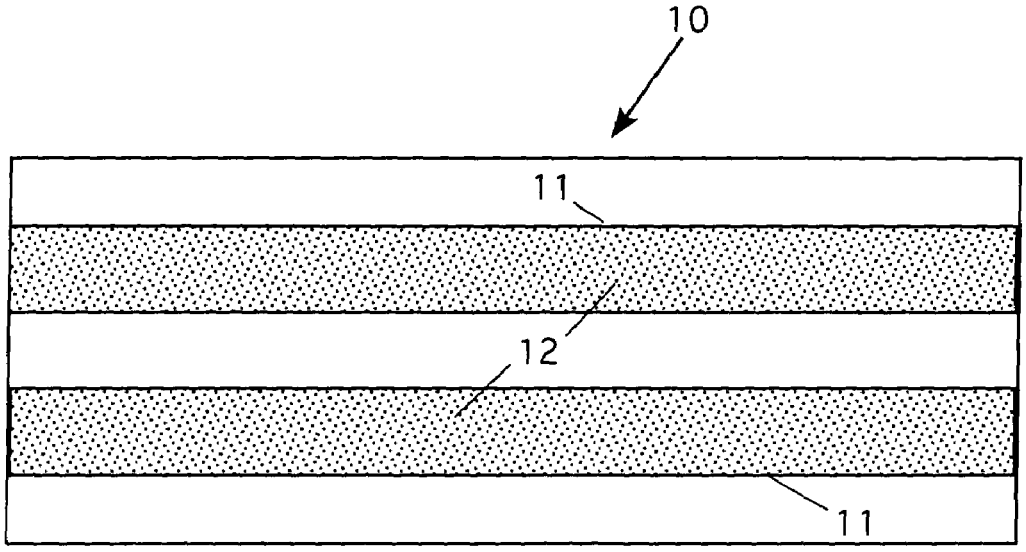
FIG. 6 is a top view of a portion of a mold showing a quantity of magnetic power placed in the mold.

Another construction method forms the top as part of a molding process. In this construction, the magnetic strips are actually a magnetic powder that is mixed with the synthetic material used to form the ladder head, which is then poured into the mold. FIG. 6 shows a portion of a mold 10. The powder that is encased in plastic, resin, fiberglass or other materials common to the art using techniques that are well know in those arts is then molded as a single piece that acts as one magnet. By using the magnetic powder in this application manufacturing costs and time can be reduced. Once the molded top is finished, the "magnet" is permanently locked into the structure. Moreover, because they are completely encased, the ladder can be used around electric facilities without danger.

The molded ladder top then becomes a magnetic tool holder that can be used like a regular ladder without cumbersome devices attached to it. Moreover, the magnetic capabilities are automatic. There is no complicated apparatus to attach and remove. The ladder instantly receives and holds tool and other items safely and securely.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A ladder comprising:

a) a formed head piece having a flat top, having an underside, and at least one side, extending downward from said flat top;

b) a pair of support members, being oppositely disposed, each of said pair of support members having a top end, the top end of each of said pair of support members being pivotably attached to said formed head piece; and c) at least one magnetic strip formed of a quantity of magnetic powder and a means for encapsulating said magnetic powder into said formed headpiece.

2. The ladder of claim 1 wherein the quantity of magnetic powder is fixedly attached to said formed headpiece by means of encapsulating the at least one magnetic strip in a resinous material.

3. The ladder of claim 1 wherein the quantity of magnetic powder is fixedly attached to the underside of said flat top of said formed head piece.

4. The ladder of claim 1 wherein the quantity of magnetic powder is fixedly attached to the at least one side.

5. A magnetic ladder comprising:

a) a generally rectangular headpiece, having an underside;

b) four sides, attached to said generally rectangular head piece and extending vertically downward therefrom, forming a box having an open bottom;

c) a pair of support members, being oppositely disposed, each of said pair of support members having a top end, the top end of each of said pair of support members being pivotable attached to said generally rectangular head piece; and d) at least one magnetic strip formed of a quantity of magnetic powder and a means for encapsulating said magnetic powder into said generally rectangular headpiece.

6. The ladder of claim 5 further comprising a second magnetic strip, fixedly attached to the underside of said generally rectangular head piece.

7. The ladder of claim 5 further comprising a plurality of magnetic strips, one of said plurality of magnetic strips being fixedly attached to each of said four sides of said box.

8. The ladder of claim 7 wherein the magnetic strips are fixedly attached to said generally rectangular head piece wherein the means of encapsulating the magnetic strips further comprises a resinous material.

9. A method of forming a magnetic top, for ladders having a head member and a pair of supports, pivotably attached to said head member, and further wherein said head member forms a mold having a plurality of formed channels therein, comprising the steps of:

a) pouring a quantity of magnetic powder into each of said plurality of formed channels; and b) filling the mold with a quantity of moldable material to encapsulate the quantity of magnetic powder.

10. The method of claim 9 further comprising the steps of:

a) before pouring a quantity of magnetic powder into each of said plurality of formed channels, coating the mold with a quantity of molded material, such that said quantity of magnetic powder is placed between two layers of molded material after step b is completed.

11. The method of claim 9 wherein the moldable material is selected from the group of: plastic, fiberglass, or resin.

* * * * *